United States Patent [19]

Keiji

[11] 4,299,329

[45] Nov. 10, 1981

[54] EXTRUSION COVER FOR CONTAINERS

[76] Inventor: Taniuchi Keiji, 6-7, Nishi-Koujiya, 2-Chome, Ota-ku, Tokyo, 144, Japan

[21] Appl. No.: 161,171

[22] Filed: Jun. 19, 1980

[30] Foreign Application Priority Data

Jul. 9, 1979 [JP] Japan ..... 54/85974

[51] Int. Cl.[3] ..... B65D 17/40

[52] U.S. Cl. ..... 220/276; 222/326; 222/541

[58] Field of Search ..... 220/268, 276; 222/541, 222/326

[56] References Cited

U.S. PATENT DOCUMENTS 3,253,733 5/1966 Brock ..... 222/276

3,815,791 6/1974 Clark ..... 222/541 X

*Primary Examiner*—George T. Hall

*Attorney, Agent, or Firm*—Sughrue, Mion, Zinn, Macpeak and Seas

[57] ABSTRACT

An extrusion cover for containers, which is made of a thin one-piece plate having a circular cutting line thereon, a frusto-conical recess in the central portion thereof defined by the cutting line, small projections on at least one portion of the tapered wall of the frusto-conical recess, and a circular plate engageable with the frusto-conical recess and adapted to push forwardly that portion of the thin plate which is inside the cutting line so as to allow the thin plate to be torn along the cutting line. This extrusion cover can be torn with a small amount of thrusting force but it is rarely opened by accident so that it is perfectly sealed at all times.

2 Claims, 5 Drawing Figures

EXTRUSION COVER FOR CONTAINERS

BACKGROUND OF THE INVENTION

The present invention relates to an extrusion cover for containers.

A container for which a cover of this kind is used is interchangeably set in an extrusion gun 1 as shown in FIG. 1.

When a lever 2 of the gun 1 is intermittently pressed, a rod 3 is forwardly driven to allow a piston 4, which is attached to the front end of the rod 3, to break through a rear cover 6 provided on a container 5. As a result, a central portion 7 of the rear cover 6, which is separated from a circumferential portion thereof by the piston 4, and which is in contact with the front end surface of the piston 4, causes an extrusion piston 8 fitted in the container 5 to be driven in the forward direction as shown in FIG. 2. The material 9 in the container 5 is thus squeezed out from an outlet 10 at the front end of the container 5 by the pressure applied to the material 9 by the extrusion piston 8.

The material subjected to extrusion in the abovedescribed manner is a dampproof, permanently elastic sealing material, such as polyurethane, which is used to fill therewith gaps occurring in buildings, electric cars, ships, airplanes, internal combustion engines, chemical machines, etc. for the purpose of preventing the leaking of rain and mixing of solvents into the structural bodies.

Since such a material is in the form of a semifluid in the container and since the material is hardened when it is brought into contact with the atmospheric air, it is necessary that the container be in a perfectly sealed state even when it is in a natural state before use.

A polyurethane sealing material referred to above is so easily affected by the atmospheric air that it cannot be assured more than several months with respect to its characteristics even if it is stored according to a regular method before use. Therefore, it is strictly necessary that the container has a perfect sealing capability.

The rear cover for the container which is forcibly torn in the above-mentioned manner has had a circular cutting line of a diameter slightly greater than the outer diameter of the piston 4, and the rear cover is broken at the cutting line to allow the central portion 7 defined thereby to be separated from the circumferential portion of the rear cover. Such a cutting line is formed by pressing the rear cover with a commonly-used metal mold.

Owing to the mechanical construction of the gun 1, a considerably high pressure can be applied to the piston 4. However, the construction of the gun 1 is very simple and the lever 2 is manually operated so that the magnitude of a pressure which can be applied to the piston 4 is limited to a certain level. Accordingly, it is desirable that the cutting line at which the central portion 7 is separated from the circumferential portion of the rear cover be formed such that the rear cover can be torn with as small an amount of force as possible. However, when the cutting line is excessively weak, the rear cover may be opened accidentally or the cutting line is broken partially by accident so that the interior of the container comes to be communicated with the atmospheric air. This often causes the material in the container to be hardened. Consequently, providing an excessively weak cutting line rather causes the extrusion cover to be exposed to an increased danger. Namely, it can be said that the reduction of extrusion force is not compatible with the increasing of the perfectness of sealing capability of the container.

An extrusion cover having a rear cover made of aluminum foil and a screw portion made of tinplate has also been proposed. However, this extrusion cover is also possibly opened by accident when the container is collided with an object or dropped.

SUMMARY OF THE INVENTION

An object of the present invention is to provide an extrusion cover for containers, which can be torn with a small amount of thrusting force applied thereto by an extrusion gun and which is rarely opened by accident in a normal condition so that the extrusion cover is in a perfect sealed state at all times.

Another object of the present invention is to provide an extrusion cover for containers, comprising a thin one-piece plate, a circular cutting line formed on the thin plate, a frustoconical recess formed in the central portion of the thin plate defined by the cutting line, small projections provided on at least one portion of the tapered wall of the recess, and a circular plate engageable with the recess and adapted to push forwardly that portion of the thin plate which is inside the cutting line so as to allow the thin plate to be torn along the cutting line.

The above and other objects as well as advantageous features of the invention will become clear from the following description of the preferred embodiment taken in conjunction with the accompanying drawings.

DESCRIPTION OF THE PREFERRED EMBODIMENT

An embodiment of the present invention will be described with reference to the accompanying drawings.

Figure 1:
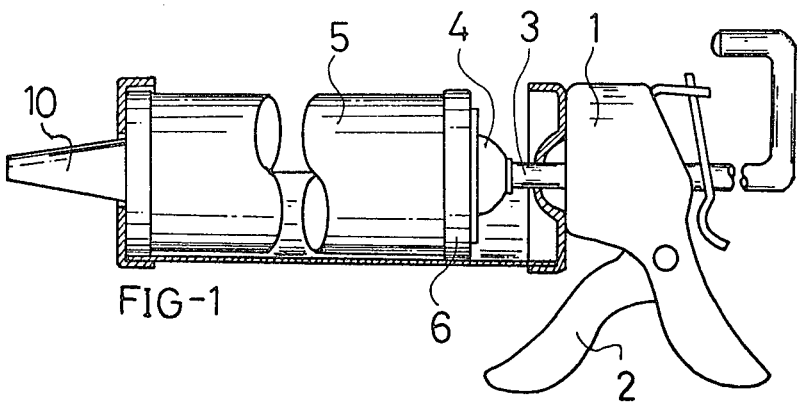
FIG. 1 is a side elevational view partially in cross section of a principal portion of a container with an extrusion cover embodying the present invention, which is set in an extrusion gun.
Figure 2:
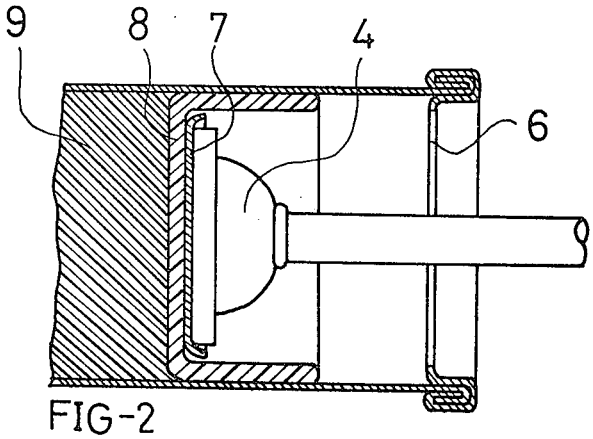
FIG. 2 is a principal portion of a container with a conventional extrusion cover in a forcibly torn state.
Figure 3:
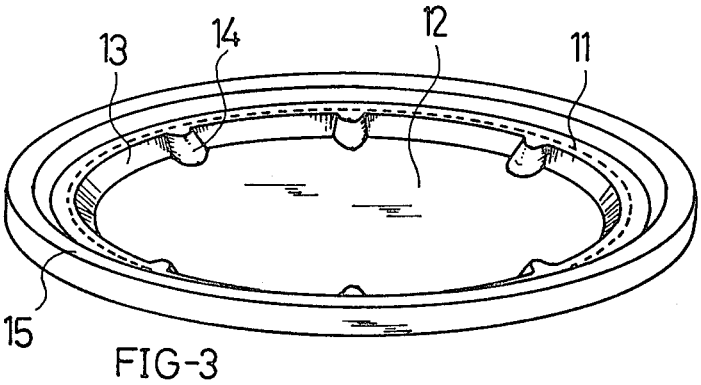
FIG. 3 is perspective view, taken from the front side, of the extrusion cover shown in FIG. 1.

An extrusion cover embodying the present invention is made of a thin one-piece plate having a circular cutting line 11, a frusto-conical recess 12 in that portion of the thin plate which is surrounded by the cutting line, and small projections 14 provided on several portions of a tapered wall 13 of the recess 12, as shown in FIG. 3.

If the tapered wall 13 of the frusto-conical recess is formed in the vicinity of the cutting line 11, the extrusion cover will display its performance effectively to a full extent.

This extrusion cover has a curling portion, at which the extrusion cover is attached to a container, around the cutting line as a conventional extrusion cover of this kind.

Figure 4:
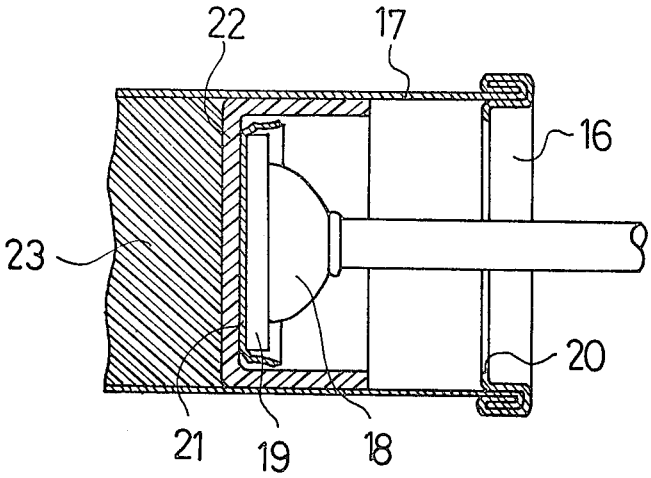
FIG. 4 is a cross-sectional view of a principal portion of the extrusion cover shown in FIG. 1, which is in a torn state.

FIG. 4 shows an extrusion cover according to the present invention which is attached to a container to be then pushed forwardly by a piston of an extrusion gun.

The extrusion cover 16 shown in FIG. 4 is sealed onto the end of a container 17, and a central portion 21 thereof which is inside a cutting line 20 is pushed forwardly to be broken by a circular plate 19 provided at the front end portion of a piston 18. A material 23 in a container is being pushed by an extrusion piston 22 which is fitted in the container and which is contacted by the central portion 21 pushed forwardly in the above-mentioned manner.

Before the material 23 has been pushed by the extrusion piston 22, the circular plate 19 provided at the front end portion of the piston 18 is fitted into the cover 16 to start pushing the same. At this time, the cover 16 is torn in such a mode as shown in FIG. 5.

Since the circular plate 19 provided at the front end portion of the piston 18 is pushed into the cover 16 as the outer circumferential portion of the circular plate is caught by side walls 24 of small projections, the side walls 24 of the small projections are crushed so that stress concentration due to the extrusion force occurs in the vicinity of the small projections in this stage of extrusion operation. As a result, the cover 16 is torn along a cutting line 25 provided in the vicinity of the small projections. In other words, these small projections constitute elements for use in causing stress concentration due to the extrusion force to occur in the vicinity of the projections so that the cover 16 is torn along the cutting line 25.

Figure 5:
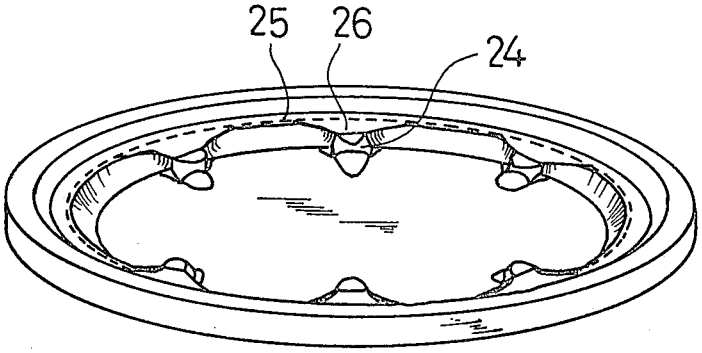
FIG. 5 is a perspective view similar to FIG. 3, in which the extrusion cover starts being torn.

If these small projections are provided in several portions of the cover 16 as shown in FIGS. 3 or 5, it is natural that the cover 16 starts being torn at each of such portions thereof as referred to above as the circular plate 19 provided at the front end portion of the piston 18 advances.

It is known that, when the cover 16 (made of a metal, such as aluminum, iron, etc.) has been partially torn along the cutting line of this kind, the remaining portion of the cover can be torn thereafter with a comparatively small amount of force. Accordingly, after the cover 16 has been torn at several portions to cause tears 26 as shown in FIG. 5, the cover 16 can be torn completely along the whole length of the cutting line with an extremely small amount of extrusion force. Since the extrusion cover according to the present invention is capped onto the end of a container in the same manner as a conventional extrusion cover, the engaging portions of the extrusion cover and container can be tightly sealed.

As may be clearly understood from the above statement, the present invention provides an optimum technical means for achieving the objects thereof mentioned above, i.e. a technical means for providing an extrusion cover which can be torn with a reduced extrusion force and which has a perfect container-sealing capability. This extrusion cover permits being contacted by the circular plate 19 such that the circular plate 19 is covered at its circumferential surface with the circumferential section of the central portion 21. Therefore, the central portion 21 can be prevented from staggering from the circular plate 19. This serves to prevent an excess amount of bending force from being applied to the rod of the piston 18, which bending force often causes the extrusion gun to be broken down. Consequently, the extrusion piston 22, which is made of a synthetic resin in most cases, can be prevented from being hurt.

An extrusion cover according to the present invention can be produced by one pressing step using upper and lower molds except the curling portion thereof. Namely, an extrusion cover according to the present invention can be manufactured by a very simple step.

The present invention is not, of course, limited to the above-described embodiment; it may be modified in various ways within the scope of the appended claims.

What is claimed is:

1. A frangible end cover for a cylindrical extrusion gun container, comprising:

(a) a thin, continuous, one-piece, circular plate member adapted to be capped over an open end of a cylindrical extrusion gun container to hermetically seal the contents thereof, (b) a frustoconical recess (12) formed in a central portion of said plate member and having a tapered sidewall (13), (c) a circular, weakened tear line (11) defined in said plate member proximate and just radially outwardly of said sidewall, said tear line not extending through said plate member, and (d) a plurality of spaced, stress concentrating projections (14) extending radially into said recess towards a center thereof from said sidewall, each projection having an end portion bearing against a planar base of said recess, (e) whereby a portion of said plate member within said tear line may be easily separated by the engagement of a circular plate (19) of an extrusion gun piston with the sloping sidewalls of said projections and the application of axial pressure by said plate.

2. An end cover as defined in claim 1, wherein each projection has a sloping sidewall.

* * * * *